US011376588B2

(12) United States Patent
Vainikka

(10) Patent No.: US 11,376,588 B2
(45) Date of Patent: Jul. 5, 2022

(54) IN VITRO DIAGNOSTIC DEVICE

(71) Applicant: Checkable Medical Incorporated, Fargo, ND (US)

(72) Inventor: Caleb Vainikka, Waconia, MN (US)

(73) Assignee: Checkable Medical Incorporated, West Fargo, ND (US)

( * ) Notice: Subject to any disclaimer, the term of this patent is extended or adjusted under 35 U.S.C. 154(b) by 0 days.

(21) Appl. No.: 17/344,818

(22) Filed: Jun. 10, 2021

(65) Prior Publication Data

US 2021/0387188 A1 Dec. 16, 2021

Related U.S. Application Data

(60) Provisional application No. 63/051,626, filed on Jul. 14, 2020, provisional application No. 63/049,452,
(Continued)

(51) Int. Cl.
*B01L 3/00* (2006.01)

(52) U.S. Cl.
CPC ..... *B01L 3/502715* (2013.01); *B01L 3/5029* (2013.01); *B01L 3/50273* (2013.01);
(Continued)

(58) Field of Classification Search
CPC ..... B01L 3/5029; B01L 2300/044; B01L 2300/0478; B01L 2300/0835; B01L 3/523;
(Continued)

(56) References Cited

U.S. PATENT DOCUMENTS 3,963,355 A 6/1976 Aldridge et al.
4,673,639 A 6/1987 Slifkin
(Continued)

FOREIGN PATENT DOCUMENTS

EP 1024354 A1 8/2000
EP 0861330 B1 8/2003
(Continued)

OTHER PUBLICATIONS

Clare, "I'm skeptical about . . . Strep throat," Roberty Alan Clare, MD, Sep. 8, 2015, retrieved from https://robertclaremd.com/im-skeptical-about-strep-throat/, last visited Feb. 16, 2021, 8 pages.
(Continued)

*Primary Examiner* — Jill A Warden
*Assistant Examiner* — Dwayne K Handy
(74) *Attorney, Agent, or Firm* — Headland Law & Strategy; Matthew J. Smyth

(57) ABSTRACT

A method of identifying the presence of an analyte may include providing an in vitro test device and a test swab; obtaining a sample using the test swab; transitioning the locking member from the first configuration to the second configuration; advancing the plunger into the housing to pierce the one or more reagent pouches in the reagent region to cause reagent therein to be released and mix; inserting the test swab with obtained sample into the interior of the plunger; rotating the in vitro test device and disposing it on its plunger base; and determining whether the analyte is present. The in vitro test device may include a plunger, a housing, one or more reagent pouches disposed in the housing, a lateral flow test strip, and a locking member having configurations that either allow or prevent reagent in the one or more reagent pouches from being released.

20 Claims, 13 Drawing Sheets

Related U.S. Application Data filed on Jul. 8, 2020, provisional application No. 63/037,595, filed on Jun. 10, 2020.

(52) U.S. Cl.
CPC ..... *B01L 3/523* (2013.01); *B01L 2200/027* (2013.01); *B01L 2200/0621* (2013.01); *B01L 2200/0673* (2013.01); *B01L 2200/16* (2013.01); *B01L 2300/044* (2013.01); *B01L 2300/047* (2013.01); *B01L 2400/0481* (2013.01)

(58) Field of Classification Search
CPC ..... B01L 2200/0621; B01L 2200/16; B01L 2300/047; B01L 2300/0672; B01L 2300/0848; B01L 2300/0851; B01L 2400/0478
See application file for complete search history.

(56) References Cited

U.S. PATENT DOCUMENTS 4,808,524 A 2/1989 Snyder et al.
4,920,046 A 4/1990 McFarland et al.
4,943,522 A 7/1990 Eisinger et al.
5,141,850 A 8/1992 Cole et al.
5,356,782 A 10/1994 Moorman et al.
5,415,994 A 5/1995 Imrich et al.
5,827,675 A 10/1998 Skiffington et al.
5,869,003 A 2/1999 Nason
5,879,635 A 3/1999 Nason
5,965,453 A 10/1999 Skiffington et al.
6,030,835 A 2/2000 Musser et al.
6,180,395 B1 1/2001 Skiffington et al.
6,248,294 B1 6/2001 Nason
6,284,459 B1 * 9/2001 Nova ..... B01J 19/0046 422/68.1
6,399,295 B1 6/2002 Kaylor et al.
6,524,530 B1 2/2003 Igarashi et al.
6,573,040 B2 6/2003 Everhart et al.
6,686,170 B1 2/2004 Flanders et al.
6,824,975 B2 11/2004 Hubscher et al.
6,890,484 B2 5/2005 Bautista et al.
6,991,898 B2 1/2006 O'Connor
7,078,061 B2 7/2006 Debad et al.
7,090,803 B1 8/2006 Gould et al.
7,098,040 B2 8/2006 Kaylor et al.
7,189,522 B2 3/2007 Esfandiari
7,312,071 B2 * 12/2007 Lu ..... C12M 23/32 435/287.6
7,371,582 B2 5/2008 Nahm et al.
7,416,892 B2 8/2008 Battrell et al.
7,444,005 B2 10/2008 Bachur et al.
7,666,614 B2 2/2010 Cheng et al.
7,682,801 B2 3/2010 Esfandiari
7,780,914 B2 8/2010 Chandler et al.
7,863,053 B2 1/2011 Lyng et al.
7,932,099 B2 4/2011 Egan et al.
8,038,965 B2 10/2011 Keren
8,067,246 B2 11/2011 Marlborough et al.
8,211,715 B1 7/2012 Royds
8,216,832 B2 7/2012 Battrell et al.
8,380,541 B1 2/2013 Holmes
8,389,230 B2 3/2013 Ohshiro
8,399,261 B2 3/2013 Kabir et al.
8,507,259 B2 8/2013 Esfandiari
8,664,001 B2 3/2014 Niskanen et al.
8,845,978 B2 9/2014 Johnson
8,877,450 B2 11/2014 Esfandiari
9,027,420 B1 5/2015 Ward
9,052,314 B2 6/2015 Dinello et al.
9,115,382 B2 8/2015 Bell et al.
9,327,284 B2 5/2016 Rosman et al.
9,435,805 B2 9/2016 Sanders et al.
9,453,996 B2 9/2016 Delahunt et al.
9,777,310 B2 10/2017 Nibhanipudi
9,784,734 B2 10/2017 Esfandiari
9,791,437 B2 10/2017 Egan et al.
9,857,372 B1 1/2018 Pulitzer et al.
9,857,373 B1 1/2018 Pulitzer et al.
9,903,863 B2 2/2018 Ohmiya
9,932,629 B2 4/2018 Hopper
10,119,968 B2 11/2018 Lansing et al.
10,331,924 B2 6/2019 Pulitzer et al.
10,473,659 B2 11/2019 Pulitzer et al.
10,527,555 B2 1/2020 Pulitzer et al.
2002/0085958 A1 7/2002 Nemcek et al.
2002/0148729 A1 10/2002 Armstrong
2003/0027359 A1 * 2/2003 Hudak ..... B01L 3/502 436/518
2003/0119202 A1 6/2003 Kaylor et al.
2003/0211634 A1 11/2003 Jerome et al.
2004/0078219 A1 4/2004 Kaylor et al.
2004/0100376 A1 5/2004 Lye et al.
2004/0151632 A1 8/2004 Badley et al.
2005/0101841 A9 5/2005 Kaylor et al.
2005/0131314 A1 6/2005 Hird et al.
2005/0249633 A1 11/2005 Blatt et al.
2005/0250141 A1 11/2005 Lambert et al.
2006/0014227 A1 1/2006 Fleming et al.
2006/0094028 A1 5/2006 Dominick et al.
2006/0166374 A1 7/2006 Hubscher et al.
2006/0292700 A1 12/2006 Wang et al.
2007/0003115 A1 1/2007 Patton et al.
2007/0092402 A1 4/2007 Wu et al.
2007/0143035 A1 6/2007 Petruno
2007/0287198 A1 12/2007 Laborde et al.
2008/0081341 A1 4/2008 Maher et al.
2008/0112847 A1 5/2008 Chen
2008/0166701 A1 7/2008 Ohmiya et al.
2008/0194013 A1 8/2008 Shida et al.
2008/0206849 A1 8/2008 Zak et al.
2008/0260581 A1 10/2008 Rosman et al.
2008/0286831 A1 * 11/2008 Liang ..... A61B 10/0096 435/34
2009/0024058 A1 1/2009 Blowick et al.
2009/0047691 A1 2/2009 Huwig et al.
2009/0061507 A1 3/2009 Ho
2009/0104690 A1 4/2009 Bayliff et al.
2009/0246751 A1 10/2009 Jensen et al.
2009/0263854 A1 10/2009 Jacono et al.
2009/0304778 A1 12/2009 Sanders et al.
2009/0305231 A1 12/2009 Weidemaier et al.
2010/0035239 A1 2/2010 Sampath et al.
2010/0273177 A1 10/2010 Piasio et al.
2010/0279308 A1 11/2010 Morrow et al.
2010/0323343 A1 12/2010 Egan et al.
2011/0008909 A1 1/2011 Homrig et al.
2011/0045515 A1 2/2011 Bell et al.
2011/0053181 A1 3/2011 Hazama et al.
2011/0144535 A1 6/2011 Guirguis
2011/0212002 A1 9/2011 Curry
2011/0213619 A1 9/2011 Henke
2011/0256541 A1 10/2011 Ecker
2012/0002199 A1 1/2012 Ben-David et al.
2012/0075626 A1 3/2012 Geva et al.
2012/0076693 A1 3/2012 Hopper
2012/0082977 A1 4/2012 Rajagopal et al.
2012/0284046 A1 11/2012 Baym et al.
2013/0023444 A1 1/2013 Kovalenko
2013/0034869 A1 2/2013 Whitesides et al.
2013/0130404 A1 5/2013 Mehra et al.
2013/0149776 A1 6/2013 Sharrock et al.
2013/0170724 A1 7/2013 Clemens
2013/0196337 A1 8/2013 Ren et al.
2013/0230844 A1 9/2013 Egan et al.
2014/0011190 A1 1/2014 Parviainen et al.
2014/0072960 A1 3/2014 Lansing
2014/0093969 A1 * 4/2014 Johnson ..... G01N 1/02 436/103
2014/0134073 A1 * 5/2014 Fuller ..... B01L 3/5029 422/411

(56) References Cited

U.S. PATENT DOCUMENTS

| | | | | |
|---|---|---|---|---|
| 2014/0227796 | A1* | 8/2014 | Gold | G01N 1/02 436/501 |
| 2014/0271410 | A1 | 9/2014 | Bosma | |
| 2014/0286550 | A1 | 9/2014 | Beule et al. | |
| 2014/0315221 | A1 | 10/2014 | Morsey | |
| 2015/0024415 | A1 | 1/2015 | Lu et al. | |
| 2015/0031014 | A1 | 1/2015 | Lu et al. | |
| 2015/0044098 | A1 | 2/2015 | Smart et al. | |
| 2015/0112248 | A1 | 4/2015 | Helliwell et al. | |
| 2015/0211966 | A1 | 7/2015 | Hsu et al. | |
| 2015/0241455 | A1 | 8/2015 | Parsons et al. | |
| 2016/0051235 | A1* | 2/2016 | Wan | A61B 10/0038 436/164 |
| 2016/0139156 | A1 | 5/2016 | Lakdawala | |
| 2016/0243543 | A1 | 8/2016 | Lui et al. | |
| 2016/0266118 | A1 | 9/2016 | Cho et al. | |
| 2016/0292393 | A1 | 10/2016 | Balwani | |
| 2016/0304827 | A1 | 10/2016 | Parikh | |
| 2016/0313307 | A1 | 10/2016 | Titmus et al. | |
| 2016/0313308 | A1 | 10/2016 | Titmus et al. | |
| 2016/0313319 | A1 | 10/2016 | Titmus et al. | |
| 2016/0327506 | A1 | 11/2016 | English et al. | |
| 2017/0113221 | A1 | 4/2017 | Hoffman et al. | |
| 2017/0173585 | A1 | 6/2017 | Mahony et al. | |
| 2017/0183714 | A1 | 6/2017 | Shen et al. | |
| 2017/0191996 | A1 | 7/2017 | Johnson et al. | |
| 2017/0196962 | A1 | 7/2017 | Nizet et al. | |
| 2017/0219573 | A1 | 8/2017 | Needham et al. | |
| 2017/0226593 | A1 | 8/2017 | Astatke et al. | |
| 2017/0234817 | A1 | 8/2017 | Bischof et al. | |
| 2017/0266657 | A1 | 9/2017 | Ayub et al. | |
| 2017/0322203 | A1 | 11/2017 | Ghatak | |
| 2017/0335379 | A1 | 11/2017 | Armes | |
| 2018/0020823 | A1 | 1/2018 | Holmes et al. | |
| 2018/0021771 | A1 | 1/2018 | Tamir | |
| 2018/0209970 | A1 | 7/2018 | Kato et al. | |
| 2018/0229232 | A1 | 8/2018 | Chang et al. | |
| 2018/0311664 | A1 | 11/2018 | Lansing et al. | |
| 2019/0232282 | A1 | 8/2019 | Pierson et al. | |

FOREIGN PATENT DOCUMENTS

| | | | |
|---|---|---|---|
| EP | 1338338 | A1 | 8/2003 |
| EP | 1697717 | A1 | 9/2006 |
| EP | 0981729 | B1 | 4/2007 |
| EP | 2879581 | A4 | 6/2015 |
| EP | 1714133 | B1 | 7/2017 |
| WO | WO2010129726 | A1 | 11/2010 |

OTHER PUBLICATIONS

CMS, "Explanation of CLIA waivers, CMS fact sheet," last visited Oct. 11, 2018, 3 pages.

FDA,"Overview of IVD Regulation," retrieved from https://www.fda.gov/medical-devices/ivd-regulatory-assistance/overview-ivd-regulation, last visited Feb. 16, 2021, 6 pages.

FDA, "Overview of Device Regulation," retrieved from https://www.fda.gov/medical-devices/device-advice-comprehensive-regulatory-assistance/overview-device-regulation, last visited Feb. 17, 2021, 3 pages.

Finkelstein et al., "Rapid Streptococcal Antigen Detection Test Performed by Parents of Children with Sore Throat," Society of Participatory Medicine, Mar. 25, 2017, retrieved from https://participatorymedicine.org/journal/evidence/research/2017/03/25/rapid-streptococcal-antigen-detection-test-performed-by-parents-of-children-with-sore-hroat/#:~:text=Rapid%20Streptococcal%20Antigen%20Detection%20Test%20Performed%20by%20Parents,and%20Warner%20V.%20Slack%20|%20March%2025,%202017, 4 pages.

Quidel Corporation," Sofia Strep A FIA," retrieved from https://www.quidel.com/sites/default/files/product/documents/EF1243801EN01.pdf, 8 pages.

Quidel Corporation, "Sofia Strep A+ FIA," retrieved from https://www.quidel.com/sites/default/files/product/documents/CL2025300EN00.pdf, 15 pages.

Trafton, "Home strep test could savef time and money," MIT News Office, May 10, 2017, retrieved from https://news.mit.edu/2017/home-strep-test-could-save-time-money-0511, last visited Feb. 16, 2021, 4 pages.

Wikipedia,"Lateral flow test," retrieved from https://en.wikipedia.org/wiki/Lateral_flow_test, last visited Oct. 11, 2018, 3 pages.

Wikipedia,"*Streptococcus*," retrieved from https://en.wikipedia.org/wiki/Streptococcus, last visited Oct. 11, 2018, 6 pages.

Wondview, Wondview Throat Testing Kit-25 Tests Per Kit-EXP-Aug. 15, 2021, Amazon, retrieved from https://www.amazon.com/Wondview-Throat-Testing-Kit/dp/B08LHLPVRY, last visited Feb. 16, 2021, 4 pages.

Thomas, Shane, Written Opinion of the International Search Authority, Form PCT/ISA/237, dated Sep. 16, 2021, 6 pages, United States.

Thomas, Shane, International Search Report, Form PCT/ISA/210, dated Sep. 16, 2021, 2 pages, United States.

* cited by examiner

IN VITRO DIAGNOSTIC DEVICE

CROSS-REFERENCE TO RELATED APPLICATIONS

This application claims priority to U.S. Provisional Application Ser. No. 63/051,626, titled "IN VITRO DIAGNOSTIC DEVICE," filed on Jul. 14, 2020; U.S. Provisional Application Ser. No. 63/049,452, titled "IN VITRO DIAGNOSTIC DEVICE," filed on Jul. 8, 2020; and U.S. Provisional Application Ser. No. 63/037,595, titled "IN VITRO DIAGNOSTIC DEVICE," filed on Jun. 10, 2020. This application incorporates the entire contents of the foregoing applications herein by reference.

TECHNICAL FIELD

Various embodiments relate generally to in vitro diagnostic devices and methods for testing for various viruses and bacteria, such as, for example, *Streptococcus*.

BACKGROUND

Every year, millions of anxious parents bring their children into a clinic, urgent care facility or emergency room presenting symptoms of pharyngitis or Group A strep. This can be a time-consuming and expensive appointment—often consuming a half-day of work or school and ultimately costing the parents $150-250 in office visit charges. And for the parents that take this step of bringing their children to a medical facility for both a rapid-test diagnosis and a longer culture-based test, 80% are sent home with negative rapid-test results, with little more than instructions to provide their ailing children with rest, fluids, over-the-counter acetaminophen and a promise of follow-up if the a more thorough culture-based test comes back positive in the following days. For many, the culture-based test does come back positive a day or two later, and the parents and their children must return to the clinic to be examined in person and for medication to be prescribed. The prescription must then be filled and picked up, often at an off-site pharmacy—adding additional time-consuming and expensive steps to the diagnosis and treatment process.

SUMMARY

In some implementations, an in vitro test device includes a plunger, a housing, one or more reagent pouches, a lateral flow test strip, and a locking member.

The plunger may have a plunger axis; a cylindrical plunger sidewall that is parallel to the plunger axis; a plunger base that is perpendicular to the plunger axis and open in the middle to enable communication with an interior of the plunger; a piercing member that is open in the middle to enable fluid communication with the interior and that has a smaller cross-sectional area than that bounded by the one or more plunger sidewalls; a test strip channel disposed in a sidewall in the one or more plunger sidewalls; a diaphragm member disposed in the plunger; and ridges disposed on an interior wall of the plunger.

The housing may have a housing axis; a cylindrical housing sidewall that is parallel to the housing axis; a housing base on a housing base end, which is perpendicular to the housing axis and closed in the middle, such that the housing base and the cylindrical housing sidewall forms a liquid-impermeable vessel; and an open end opposite the housing base that slidably receives the plunger.

The one or more reagent pouches may be disposed inside the housing, adjacent the housing base end, in a reagent region. The lateral flow test strip may be disposed in the test strip channel. The locking member may have a first configuration and a second configuration. In the first configuration, the locking member may prevent the piercing member from impinging into the reagent region. In the second configuration, the locking member may allow the plunger to be translated into the housing such that the piercing member impinges into the reagent region. The diaphragm member may be configured to prevent reagent from the one or more reagent pouches from leaking out of the interior when the reagent has been released from the one or more reagent pouches and when the in vitro test device is positioned vertically on its plunger base. The ridges may be configured to compress a sample collection portion of a test swab, as the test swab is passed into the interior.

In some implementations, an in vitro test device includes a plunger, a housing, one or more reagent pouches, a lateral flow test strip and a locking member.

The plunger may have a plunger axis; one or more plunger sidewalls that are parallel to the plunger axis; a plunger base that is perpendicular to the plunger axis and open in the middle to enable communication with an interior of the plunger; a piercing member that is open in the middle to enable fluid communication with the interior and that has a smaller cross-sectional area than that bounded by the one or more plunger sidewalls; and, a test strip channel disposed in a sidewall in the one or more plunger sidewalls.

The housing may have a housing axis; one or more housing sidewalls that are parallel to the housing axis; a housing base on a housing base end, which is perpendicular to the housing axis and closed in the middle, such that the housing base and the one or more housing sidewalls form a liquid-impermeable vessel; and an open end opposite the housing base that slidably receives the plunger.

The one or more reagent pouches may be disposed inside the housing, adjacent the housing base end, in a reagent region. The lateral flow test strip may be disposed in the test strip channel. The locking member may have a first configuration and a second configuration. In the first configuration, the locking member may prevent the piercing member from impinging into the reagent region. In the second configuration, the locking member may allow the plunger to be translated into the housing such that the piercing member impinges into the reagent region.

In some implementations, the one or more sidewalls comprise a single sidewall having a generally cylindrical form. In some implementations, the one or more sidewalls comprise four sidewalls having a generally square cross section.

The in vitro test device may further include a diaphragm member disposed in the plunger. The diaphragm member may be configured to prevent reagent that has been released from the one or more reagent pouches from leaking out of the interior when the in vitro test device is positioned vertically on its plunger base. The test strip channel may include an opening into the interior, such that when a test strip is disposed in the test strip channel, a portion of the test strip is adjacent the diaphragm member.

The plunger may further include ridges disposed on an interior wall of the plunger and spaced to compress a sample collection portion of a test swab, as the test swab is passed into the interior.

At least one of the plunger base and housing base may include a flat edge that prevents the in vitro test device from rolling when the in vitro test device is positioned horizontally relative to a surface and the flat edge is in contact with the surface.

In some implementations, each of the plunger base and the housing base include a flat edge, and the in vitro test device further includes a keying mechanism to align the plunger and housing in a fixed orientation relative to each other and to a plunger axis and a housing axis.

In some implementations, the in vitro test device further includes indicia on at least one of the plunger base or housing base. The indicia may provide a user with instructions regarding using the in vitro test device. The indicia may include indicia to guide manipulation of the plunger relative to the housing, or a test swab associated with the in vitro test device relative to the plunger. The indicia may include indicia to guide a user with respect to a time period during which the in vitro test device is to be positioned in a specific spatial orientation.

In some implementations, a method of identifying the presence of an analyte includes providing an in vitro test device and a test swab; obtaining a sample using the test swab; transitioning a locking member from a first configuration to a second configuration; advancing a plunger into a housing to pierce one or more reagent pouches in a reagent region to cause reagent therein to be released and mix; inserting the test swab with an obtained sample into the interior of the plunger; rotating the in vitro test device and disposing it on a plunger base; and determining whether the analyte is present.

The in vitro test device may include (a) a plunger having a plunger axis; one or more plunger sidewalls that are parallel to the plunger axis; a plunger base that is perpendicular to the plunger axis and open in the middle to enable communication with an interior of the plunger; a piercing member that is open in the middle to enable fluid communication with the interior and that has a smaller cross-sectional area than that bounded by the one or more plunger sidewalls; and, a test strip channel disposed in a sidewall in the one or more plunger sidewalls; (b) a housing having a housing axis; one or more housing sidewalls that are parallel to the housing axis; a housing base on a housing base end, which is perpendicular to the housing axis and closed in the middle, such that the housing base and the one or more housing sidewalls form a liquid-impermeable vessel; and an open end opposite the housing base that slidably receives the plunger; (c) one or more reagent pouches disposed inside the housing, adjacent the housing base end, in a reagent region; (d) a lateral flow test strip disposed in the test strip channel; (e) a locking member having a first configuration and a second configuration; wherein, in the first configuration, the locking member prevents the piercing member from impinging into the reagent region, and wherein, in the second configuration, the locking member allows the plunger to be translated into the housing such that the piercing member impinges into the reagent region.

The method may further include agitating at least one of the test swab or the in vitro test device. Rotating the in vitro test device may include rotating after an extraction incubation period. A mixing incubation period may separate the advancing and inserting steps. Determining may include determining based on observation of a results section of the lateral flow test strip. Determining may include determining after a testing incubation period.

At least one of the plunger base and the housing base may include a flat edge, and the method may further include rotating the in vitro test device such that its plunger axis and housing axis are parallel to a horizontal surface, and resting the flat edge on the horizontal surface.

DETAILED DESCRIPTION

Described herein are various implementations of in vitro test devices and kits that can be used in an at-home setting to determine the presence of certain analytes, such as, for example a carbohydrate antigen that is unique to Group A *Streptococcus* bacteria. Such bacteria can cause strep throat, impetigo, cellulitis and other skin and soft tissue infections. By detecting its presence, or confirming its absence, appropriate treatment may be coordinated—in some cases, from home, without an expensive, time-consuming, burdensome, risk-enhancing visit to a clinic. Analytes other than those associated with Group A *Streptococcus* may also be detected with the implementations described herein.

Figure 1A:
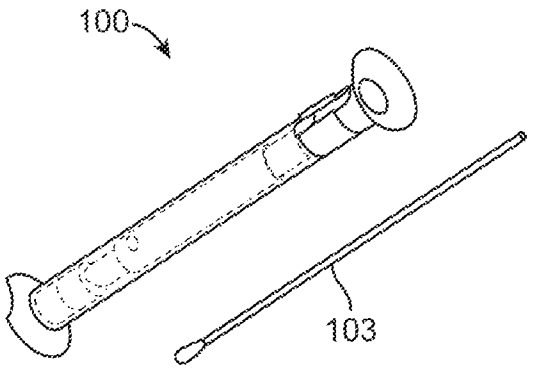
FIG. 1A is perspective view of an exemplary in vitro test device.

FIG. 1A is perspective view of an exemplary in vitro test device 100 and its associated test swab 103. In some implementations, the test device 100 and test swab 103 are packaged together in a "kit," which may be sold to consumers for purposes of determining whether certain bacteria are present (e.g., group A *Streptococcus* bacteria).

A user may employ the test swab 103 to take a biological sample (e.g., a pharyngeal sample), then employ the in vitro test device 100 in the manner described herein to determine—via a rapid, at-home test—whether the bacteria of interest is present, such that appropriate follow-up action can be taken (e.g., a prescription antibiotic secured).

Figure 1B:
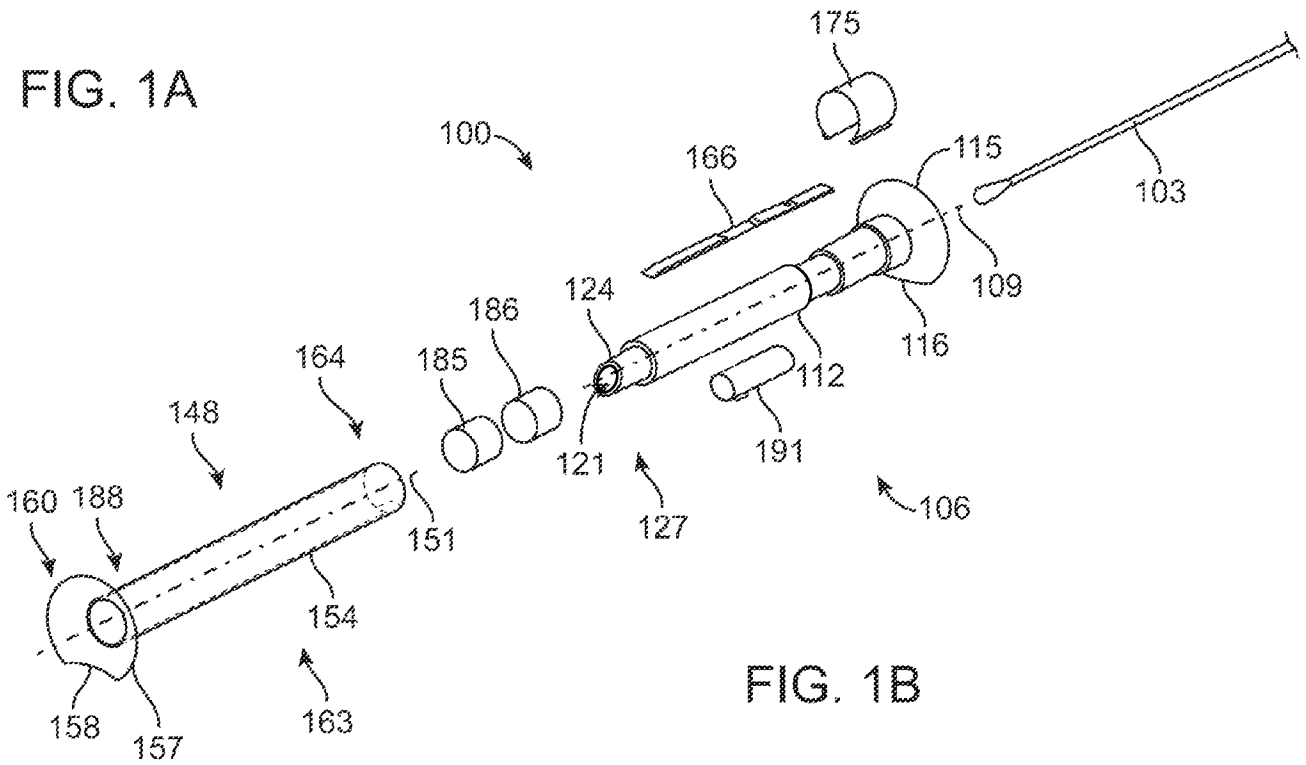
FIG. 1B is an exploded view of the exemplary in vitro test device of FIG. 1A.

As shown in FIG. 1B, the test device 100 includes a plunger 106 and a housing 148. As shown, the plunger 106 has a plunger axis 109 and a sidewall 112 that is parallel to the plunger axis 109. In the implementation shown, the sidewall 112 is a generally cylindrical sidewall; in other implementations, the sidewall 112 could comprise one or more distinct sidewalls, each of which is generally perpendicular to the plunger axis. For example, in some implementations, the sidewall comprises four sides and has a generally square cross-section.

On one end of the plunger 106 is disposed a plunger base 115, which, in some implementations, is perpendicular to the plunger axis 109. The plunger base 115 is open in the middle (not visible in FIG. 1B) to allow communication with an interior 121 of the plunger 106.

Opposite the plunger base 115, on a piercing end 127 of the plunger 106, is disposed a piercing member 124. The piercing member 124 is, in some implementations, an angled or sharpened protrusion that has a smaller diameter (and smaller cross-sectional surface area) than a diameter (or cross-sectional surface area bounded by the sidewalls) of the plunger 106 itself.

Like the plunger base 115, the piercing member 124 is open in the middle to enable communication with the interior 121 of the plunger. In operation, the test swab 103 may be slid into and through the interior 121, through the open middle of the plunger base 115, through the middle of the plunger 106 and out the middle of the piercing member 124.

The test device 100 further includes a housing 148 having a housing axis 151. The housing 148 has a housing sidewall 154 that is parallel to the housing axis 151, and a housing base 157, on a base end 160 of the housing, which is perpendicular to the housing axis 151. The housing base 157 is closed in the middle, such that the housing base 157 and the sidewall 154 form a closed (e.g., liquid-impermeable) vessel 163.

On the housing 148, opposite the housing base end 160, is an open end 164, which is configured to slidably receive the plunger 106. That is, the plunger 106 and housing 148 are configured such that plunger 106 can slide inside the housing 148 with a relatively tight fit (in some implementations, a liquid-tight fit), yet loose enough to permit translation of the two components during operation of the device 100.

In some implementations, the housing base 157 may include a flattened edge 158 to enable the device 100 to lay flat on a horizontal surface without rolling. The plunger base 115 may also have a flattened surface 116. In some implementations, only one of the plunger base 115 or housing base 157 has a flattened edge (116 or 158, respectively); in other implementations, both plunger base 115 and housing base 157 have flatted edges 116 and 158, and the plunger 106 and housing 148 may be keyed in some manner to maintain like orientation of the two flattened edges 116 and 158.

As shown, the test device 100 further includes reagent pouch 185 and reagent pouch 186. In some implementations, the reagent pouches 185 and 186 are disposed inside the housing 148 adjacent the base end 160, in a reagent region 188. The reagent pouches 185 and 186 may be constructed with sidewalls that are configured to fit into the housing 148; in some implementations, a top and bottom surface (e.g., surfaces that are perpendicular to the housing axis 151) are constructed of a foil or other thin material that is easily ruptured, e.g., by translation of the piercing member 124 into the reagent region 188. The function of the reagent pouches is explained with reference to a lateral flow test strip 166, and with reference to a lateral flow test strip 366 in FIG. 3.

Figure 3:
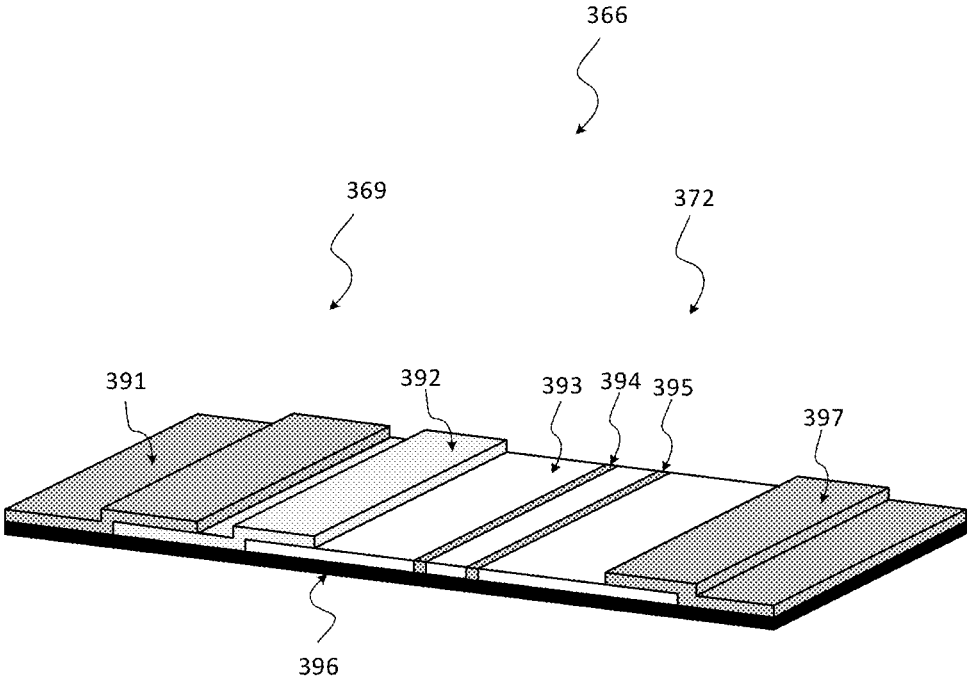
FIG. 3 illustrates an exemplary lateral flow test strip.

FIG. 3 illustrates an exemplary lateral flow test strip 366. As shown, the lateral flow test strip 366 includes a sample section 369, which receives a sample solution; and a results section 372, where results are displayed.

The process of preparing a sample for application to the lateral flow test strip 366 are briefly described. A sample may be collected in various ways, depending on the type of sample and its origin. For example, a urine sample may be collected directly on the lateral flow test strip 366 (e.g., in the case of a pregnancy test); as another example, a sample, such as a pharyngeal saliva sample, may be collected on a swab (e.g., the swab 103) or other sample collection device. In cases in which a swab or other sample device is used to collect a sample, the sample may be extracted into a liquid media that can then be transferred to the lateral flow test strip.

In some implementations, the sample is extracted by an acid, such as nitrous acid. Such an acid may serve as an oxidizing agent that breaks down cell walls of an antigen-containing target bacteria (e.g., *Streptococcus* bacteria), to release the analyte of interest. Acids that are useful in such extraction processes may be very unstable; thus, it may be important to prepare the acids immediately prior to use.

One way these acids can be formed is with separate reagents that are mixed immediately prior to sample extraction. For example, in some implementations, two reagents are used—one containing a nitrite salt, such as a sodium nitrite solution, and one containing an acid, such as acetic acid. In such implementations, the combination of sodium nitrite and acetic acid produce nitrous acid. In other implementations, different reagents may be employed—such as, for example, phosphoric acid, citric acid, guanidinium thiocyanate, sodium hydroxide, etc.

In some implementations, dyes may be added, or the reagents may be selected, such that a color change occurs when the reagents are mixed. In such implementations, the color change can provide a user with confirmation that the reagents have been mixed and are ready to receive a sample for extraction and testing.

In some implementations, the separate pouches 185 and 186 (FIG. 1B) may contain the separate components (e.g., sodium nitrite and acetic acid) necessary to make an oxidizing agent that can extract an analyte of interest. By piercing these pouches to release and combine their contents, the extraction solution can be prepared, into which a sample-containing swab can be inserted to transfer the target analyte to the solution itself. Once the target analyte is in the solution, that solution can be transferred to the later flow test strip 366—which is now described in more detail.

The exemplary lateral flow test strip 366 includes a sample pad 391—the location at which sample liquid is applied. The sample pad 391 is absorbent and may, in some cases, include buffer salts and/or surfactants to assist a sample in flowing across the lateral flow test strip 366. Adjacent the sample pad is a conjugate release pad 392. In some implementations, the conjugate release pad 392 includes mobile detection particles that bind to target analytes. These detection particles may also be bound to colored or fluorescent particles—colloidal gold or latex microspheres in some implementations. Thus, in the conjugate release pad 392, conjugates are formed between target analytes and the detection particles.

The lateral flow test strip 366 includes a membrane that 393 that causes the liquid sample (including the extracted analyte and any conjugate formed between extracted analyte and detection particles) to flow from the sample pad 391, towards an absorbent pad 397. Between the sample pad 391 and the absorbent pad 397 lies a test line 394 (or, in some cases, more than one test line) and a control line 395.

The test line 394 may comprise immobilized antibodies or antigens that are configured to react with target analytes, causing the detection particles to be aggregated at the test line 394. After enough target detection particles aggregate at the test line 394, they may be visually apparent as a line having a contrasting color relative to the membrane 393. If target analytes are not present in the solution passing the test line 394, no reaction occurs, and the conjugate analyte/detection particles flow past the test line 394 without aggregating into a visual line.

The lateral flow test strip 366 further includes a control line 395 that confirms proper capillary flow of the test solution across the membrane 393. In some implementations, the control line 395 appears as a visual line as soon as test solution flows past—regardless of whether a target analyte is present or not. The appearance of this line may provide some confirmation that the lateral flow test strip 366 is properly functioning.

As shown, the sample pad 391, conjugate release pad 392, membrane 393 with test strip 394 and control strip 395, and the absorbent pad 397 are all supported by a backing card 396—typically a substrate (e.g., thick paper, cardboard, plastic, polymer, etc.) to support and configure relative to each other the components of the later flow test strip 366.

Returning to FIG. 1A, the test device 100 further includes a removable locking clip 175 that is configured to removably clamp onto a portion of the plunger 106 to prevent the plunger 106 from sliding too far into the housing 148. In some implementations, this locking clip 175 is in place in a first configuration, prior to the test device 100 being used, and it prevents the piercing member 124 from impinging on reagent region 188 and piercing the reagent pouches 185 and 186 in that first configuration. During operation, when it is intended for the piercing member 124 to pierce the reagent pouches 185 and 186, the removable locking clip 175 can be removed and the plunger depressed (a second configuration—in which the plunger 106 is more deeply disposed in the housing 148, wherein the piercing member 124 is disposed in the reagent region 188).

As shown, the test device 100 also includes a diaphragm member 191 disposed in the plunger. As will be explained in more detail with reference to other figures, in some implementations, the diaphragm 191 member is configured to provide a liquid seal around a test swab 103, when said test swab 103 is inserted into and through the plunger 106.

Figure 2A:
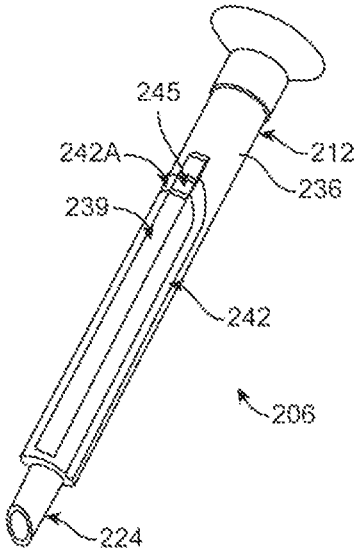
FIG. 2A is a perspective view of an exemplary plunger.

FIG. 2A illustrates additional details of an exemplary plunger 206. Disposed on an exterior surface 236 of the plunger 206 (e.g., recessed in the thickness of sidewall 212) is a test strip channel 239 and a fluid channel 242. The test strip channel 239 and the fluid channel 242 intersect as a sample region 245. In some implementations, there is more than one fluid channel 242. For example, as shown (only partially visible), a second fluid channel 242A extends just beyond the sample region 245 and extends parallel to the fluid channel 242, towards a piercing member 224.

Figure 2B:
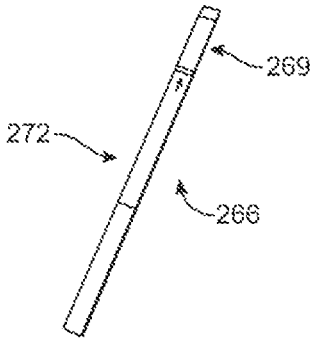
FIG. 2B illustrates and exemplary lateral flow test strip.

FIG. 2B illustrates an exemplary lateral flow test strip 266. The test strip channel 239 is configured to receive the lateral flow test strip 266, which, in some implementations, includes a sample section 269, which is configured to receive a liquid sample; and a results section 272.

Figure 2C:
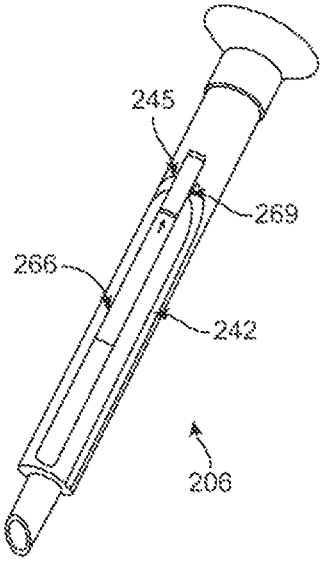
FIG. 2C is a perspective view of an exemplary plunger and test strip.

In some implementations, as shown in FIG. 2C, the plunger 206 is configured such that the lateral flow test strip 266 fits into the test strip channel 239 in a manner that aligns its sample section 269 with the sample region 245 that is at the intersection of the test strip channel 239 and the fluid channel 242. As will be described in more detail, sample fluid may flow down the fluid channel 242 and reach the lateral flow test strip 266 at its sample section 269, at the sample region 245.

Figure 4A:
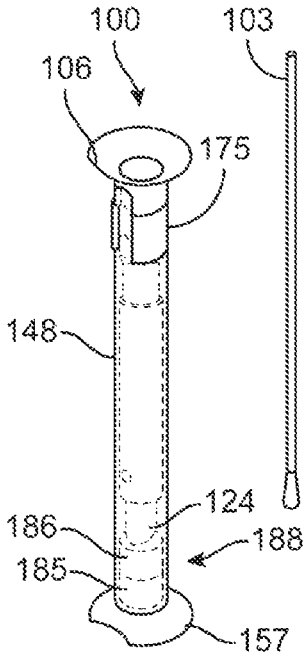
FIGS. 4A-4G pictorially depict the operation of the exemplary test device of FIGS. 1A and 1B.

FIGS. 4A-4H pictorially depict the operation of the exemplary test device 100. As depicted in FIG. 4A, the test device 100 and swab can be removed from the packaging in which they came. In its packaging, the test device 100 is protected by the removable locking clip 175. That is, the test device 100 is in a first configuration, such that the plunger 106 is maintained in the housing 148 in a manner that prevents the piercing member 124 from impinging upon the reagent region 188 and piercing either reagent pouch 186 or reagent pouch 185. The test device may be positioned vertically, such that it is supported by the housing base 157.

Figure 4B:
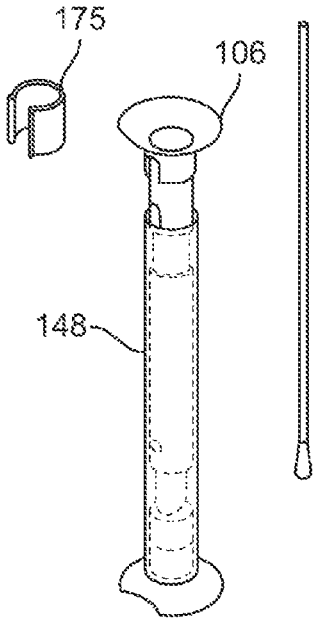

As depicted in FIG. 4B, the removable locking clip 175 is removed. This facilitates additional translation of the plunger 106 within the housing 148.

Figure 4C:
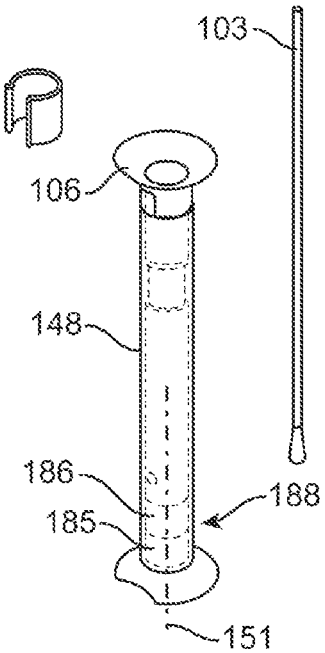

As depicted in FIG. 4C, the plunger 106 is depressed, or translated more deeply into the housing 148. The piercing member (not visible in FIG. 4C) impinges into the reagent region 188, and that piercing member pierces the reagent pouch 186 and reagent pouch 185. In some implementations, the reagent pouch 186 and reagent pouch 185 are cylindrical in shape, to match the shape of the housing 148, and they may have rigid sidewalls; their top and bottom surfaces (those that are perpendicular to the axis 151 of the housing), however, may comprise an easily pierceable foil or other membrane. Thus, when the piercing member impinges on the reagent region 188, both reagent pouch 186 and reagent pouch 185 may be pierced, releasing their contents into a common space and allowing those contents to mix.

In some implementations, the mixing of the reagents contained in the reagent pouch 186 and the reagent pouch 185 causes a solution to be formed that is suitable for extracting a sample from the swab 103. For example, in some implementations, reagent pouch 186 contains sodium nitrite solution, reagent pouch 185 contains acetic acid, and when the two reagent pouches 186 and 185 are pierced and their contents are combined, nitrous acid is a formed—an acid that may be effective in extracting a sample from the swab 103.

Figure 4D:
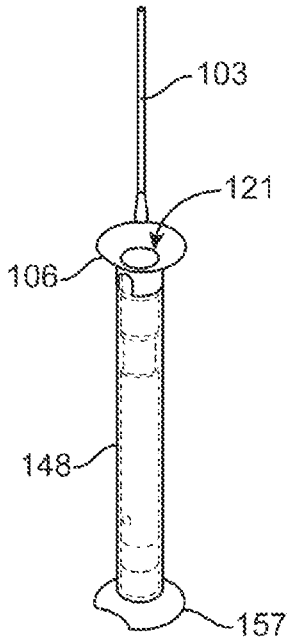
Figure 4E:
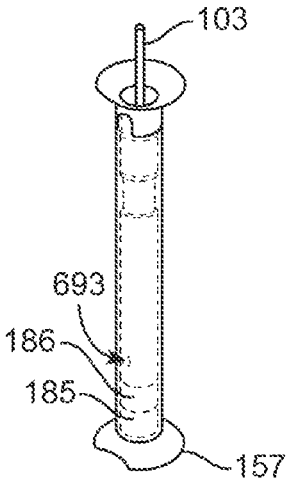

As depicted in FIGS. 4D and 4E, the swab 103 (with a sample contained thereon, such as a pharyngeal saliva sample) is inserted into the interior 121 of the plunger. Once fully inserted, a tip of the swab 103 containing the sample comes into contact with the mixed contents of reagent pouch 186 and reagent pouch 185 (e.g., an "extraction solution"). This extraction solution (e.g., nitrous acid in some implementations) may cause relevant portions of the sample to be extracted from the swab 103, into the extraction solution itself.

In some implementations, the housing 148 and plunger 106 are agitated for a short period of time, prior to the swab 103 being inserted. In some implementations, a short "mixing incubation period" may also be provided prior to the swab being inserted 103 (e.g., to enable the multiple reagents to fully mix). The desire or need for agitation or incubation may depend on the specific reagents employed and the nature of a target sample.

Figure 4F:
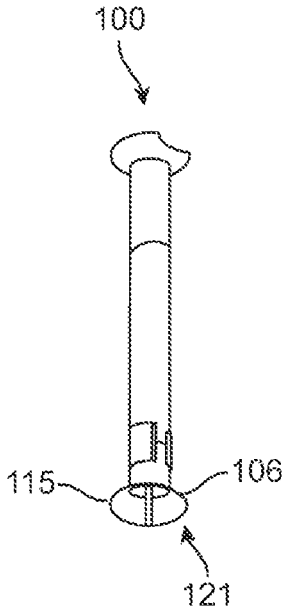

As depicted in FIG. 4F, the test device 100 is rotated 180 degrees, such that it is vertically oriented and resting on its plunger base. In some implementations, this rotation occurs after an "extraction incubation period"—a period of time during which the extraction solution chemically and biologically acts on the sample to extract a target analyte. The extraction incubation period may be 30 seconds, 1 minute, 2 minutes, 3 minutes, 5 minutes, or some other period of time that facilitates extraction of sufficient quantity of analyte for use in subsequent steps.

As shown in one implementation, the swab 103 remains disposed in the test device 100 once it is rotated. In such implementations, the diaphragm 191 (shown in FIG. 1B) may prevent the extraction solution from leaking out through the interior 121 portion of the plunger 106. Once the test device 100 is rotated, (with reference to FIGS. 2A and 2C) the extraction solution may be directed to the sample region 245 via the fluid channel 242, causing the extraction solution to come into contact with the sample section 269 of the lateral flow test strip 266. In other implementations, the test swab 103 may be removed before the test device 100 is rotated.

Figure 4G:
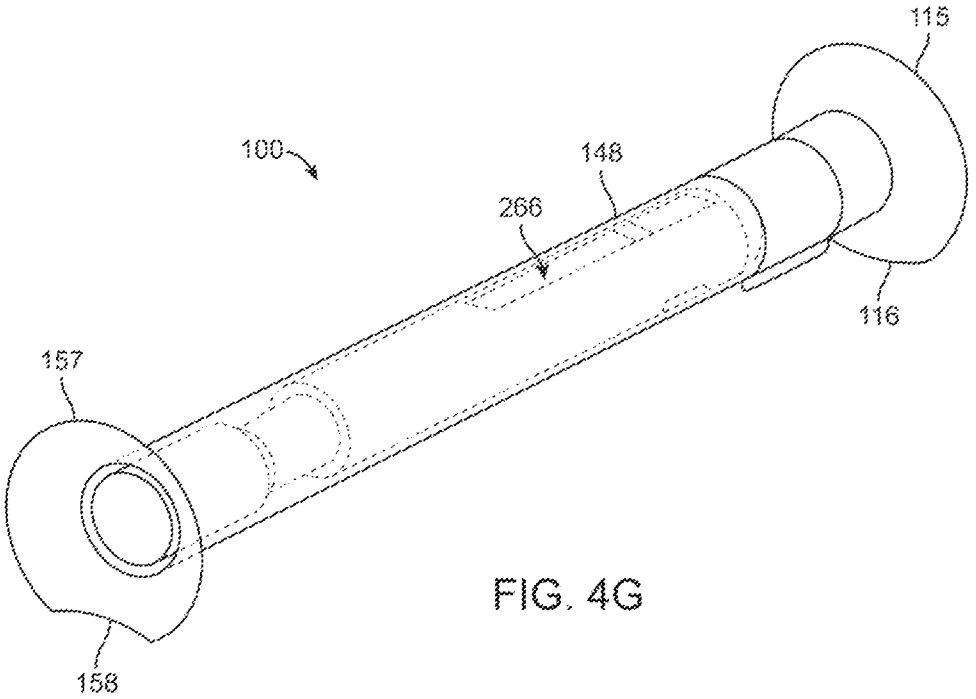

As depicted in FIG. 4G, the test device 100 may be rotated again and placed horizontally, such that it rests, in a rotation-free manner, on a flat portion 158 of the housing base 157 and/or on a flat portion 116 of the plunger base 115. In this position, it may be possible for a user to easily read results of the later flow test strip 266 (e.g., through a transparent or semi-transparent portion of the housing 148).

In some implementations, the test device 100 is not rotated horizontally until after a "testing incubation period"—a period of time during which (with reference to FIG. 3) the extraction solution wicks from the sample pad 391, through the conjugate release pad 392, across the membrane 393, and through the test line 394 and control strip 395 in the results section 372. The testing incubation period may be 30 seconds, 1 minute, 2 minutes, 3 minutes, 5 minutes, or some other period of time that facilitates movement of the extraction solution across the lateral flow test strip 266 or 366.

Figure 5:
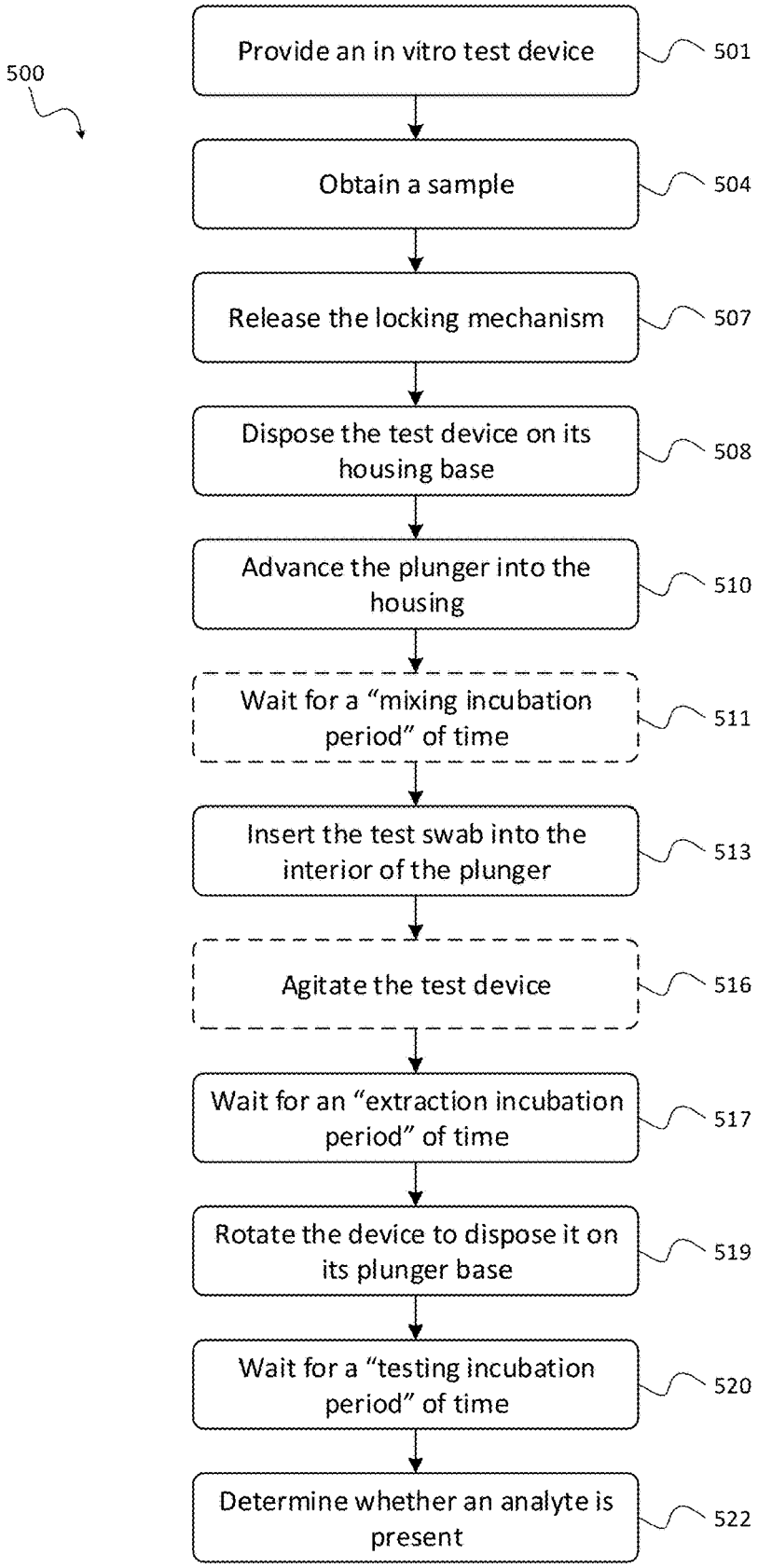
FIG. 5 is a flow diagram of an exemplary method for performing a test.

FIG. 5 is a flow diagram of an exemplary method 500 for performing a test using an exemplary in vitro test device. As depicted, the method 500 includes providing (501) an in vitro test device, such as, for example, the in vitro test device 100 and corresponding test swab 103.

The method 500 further includes obtaining (504) a sample using the test swab. For example, a user may obtain a pharyngeal saliva sample from a patient using the test swab 103.

The method 500 further includes releasing (507) the locking mechanism. For example, with reference to FIG. 1B and FIG. 4B, the locking clip 175 may be removed, to enable the plunger 106 to translate relative to the housing 148. In some implementations, the locking mechanism may have a different form than the locking clip 175 (e.g., see locking mechanism 875, illustrated in and described with reference to FIG. 8C).

The method 500 further includes disposing (508) the device on its housing base (e.g., vertically oriented, on the housing base 157—for example, as shown in FIG. 4B.

The method 500 further includes advancing (510) the plunger into the housing. For example, with reference to FIG. 1B and FIG. 4C, the plunger 106 may be advanced into the housing 148, such that the piercing member 124 impinges on the reagent region 188, causing the reagent pouch 186 and the reagent pouch 185 to be pierced, such that their contents mix, forming an extraction solution. In some implementations, the method 500 includes waiting (511) a "mixing incubation period" of time, to allow the reagents to fully mix with each other, to form an extraction solution.

The method 500 further includes inserting (513) the test swab into the plunger. For example, with reference to FIG. 4D and FIG. 4E, the test swab 103 may be inserted into the plunger 106, specifically into the interior space 121, bringing the sample end of the test swab 103 into contact with the extraction fluid, which, as shown, will be adjacent the housing base 157.

The method 500 further includes, in some implementations, agitating (516) the test device. This step could include, for example, "swirling" the test device 100 or test swab 103 in a circular motion to agitate the extraction fluid and increase its interaction with the test swab—to promote or expedite extraction of a sample contained on the test swab. The method 500 further includes waiting (517) for an "extraction incubation period" of time, to allow for sufficient sample to be extracted by and into the extraction solution, from the test swab.

The method 500 further includes rotating (519) the test device. For example, with reference to FIG. 4F, the test device 100 is rotated (519) such that it is vertically oriented on its plunger base 115. In some implementations, in this configuration, the extraction fluid—which will now include any target analyte from the test swab 103—will flow to the lateral flow test strip (e.g., via the fluid channel 242 shown in FIG. 2A and FIG. 2C, to the sample region 245 and the sample 269 on the lateral flow test strip 266).

The method 500 further includes waiting (520) for a "testing incubation period" of time. In some implementations, this period of time allows the extraction fluid to wick up the lateral flow test strip (e.g., the membrane 393), such that any target analyte in the extraction fluid will cause a test line 394 to appear; regardless of the presence of any target analyte, in some implementations, wicking of the extraction fluid past the control line 395 will cause a visible line to appear there.

The method 500 further includes determining (522) whether an analyte is present. In some implementations, this includes determining (522) whether a test line is present on the lateral flow test strip. For example, with reference to FIG. 3, this could include determining (522) whether two lines are present (e.g., both a test line 394 and a control line 395)—as opposed to no lines (e.g., in the case of a faulty lateral flow test strip) or only one line (e.g., a control line 395).

In some implementations, steps in the method 500 may be reordered or omitted, or other steps may be added. For example, in some implementations, it may not be necessary to agitate (516) the test device. In some implementations, it may not be necessary to wait (511) for a mixing incubation period of time. In some implementations, the locking clip may be removed (507), the test device disposed (508) on its base, and the plunger advanced (510) prior to the sample being obtained (504); in this manner, the sample may be obtained while the user is waiting (511) for any necessary incubation period of time. In some implementations, the test swab may be removed from the test device prior to the test device being rotated (519). In such implementations, removal of the test swab facilitate a "squeezing" of the tip of the test swab by a diaphragm (e.g., the diaphragm 191 shown in FIG. 1B), which may cause addition sample to be extracted from the test swab. In such implementations, an additional agitation step may be added prior to the test device being rotated (519). The waiting (520) step may be omitted or inherent in the process; that is, the user may simply determine (522) whether two lines appear on the lateral flow test strip, without "waiting" (520) an explicit period of time. Other variations are possible.

Figure 6:
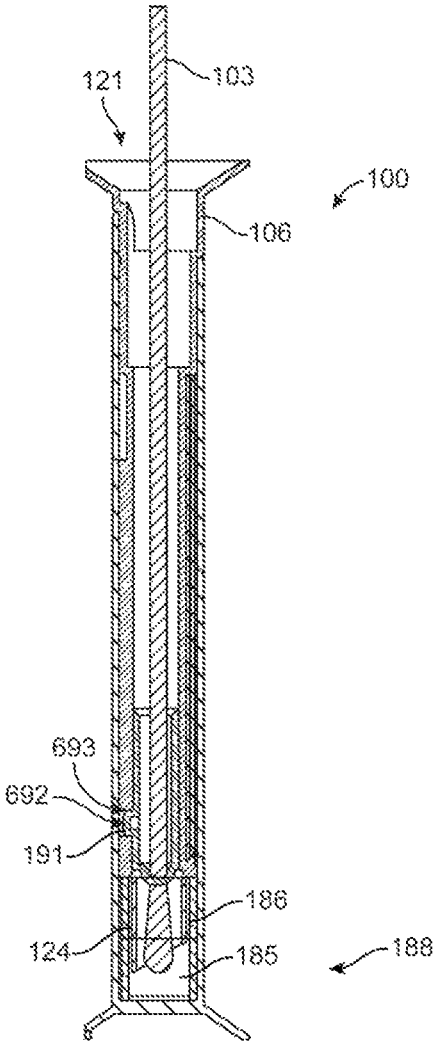
FIG. 6 is a cross-section of an exemplary test device.

FIG. 6 is a cross-section of the test device 100, with the piercing member 124 of the plunger disposed in a second configuration, in which it impinges on the reagent region 188, piercing the reagent pouch 186 and reagent pouch 185. As shown, the test swab 103 is disposed in the interior space 121 of the plunger 106. FIG. 6 further illustrates how the diaphragm 191 can, in some implementations, provide a seal around the test swab 103. In such implementations, the reader will appreciate how that seal may prevent or limit extraction solution from leaking through the interior space 121 when the test device 100 is rotated. In some implementations, the diaphragm 191 may also provide a seal that substantially prevents reagent (or much reagent) from leaking out of the interior space 121 (whether or not the test swab 103 is in place) when the test device is rotated such that its plunger base 115 is on the bottom.

In some implementations, such as the one shown, the diaphragm member 191 has a protrusion 692 that interfaces with an opening 693 in the plunger body (see also FIG. 4E)—for example, to anchor the diaphragm member 191 in place in the plunger. In other implementations, the diaphragm member 191 is anchored in another manner (e.g., with adhesive, or with a multi-step or co-molding process). In still other implementations, the diaphragm member 191 is omitted.

Figure 7:
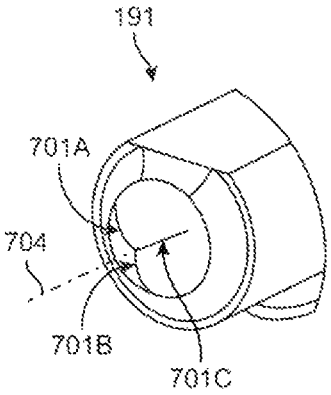
FIG. 7 is a perspective view of a portion of an exemplary diaphragm.

FIG. 7 is a perspective view of a portion of an exemplary diaphragm member 191. As shown, the diaphragm member includes slits 701A, 701B and 701C. In some implementations, these slits 701A, 701B and 701C converge at an axis 704 of the diaphragm member 191. The diaphragm 191 may comprise a resilient material that permits passage of a test swab therethrough. The material may be both stiff enough and flexible enough to substantially seal against the test swab. In addition, the material may be stiff enough to effectively "squeeze" the test swab as it is removed from the test device 100 (e.g., to extract additional extraction fluid, with, in some cases, target analyte—to enhance the extraction process).

Figure 8A:
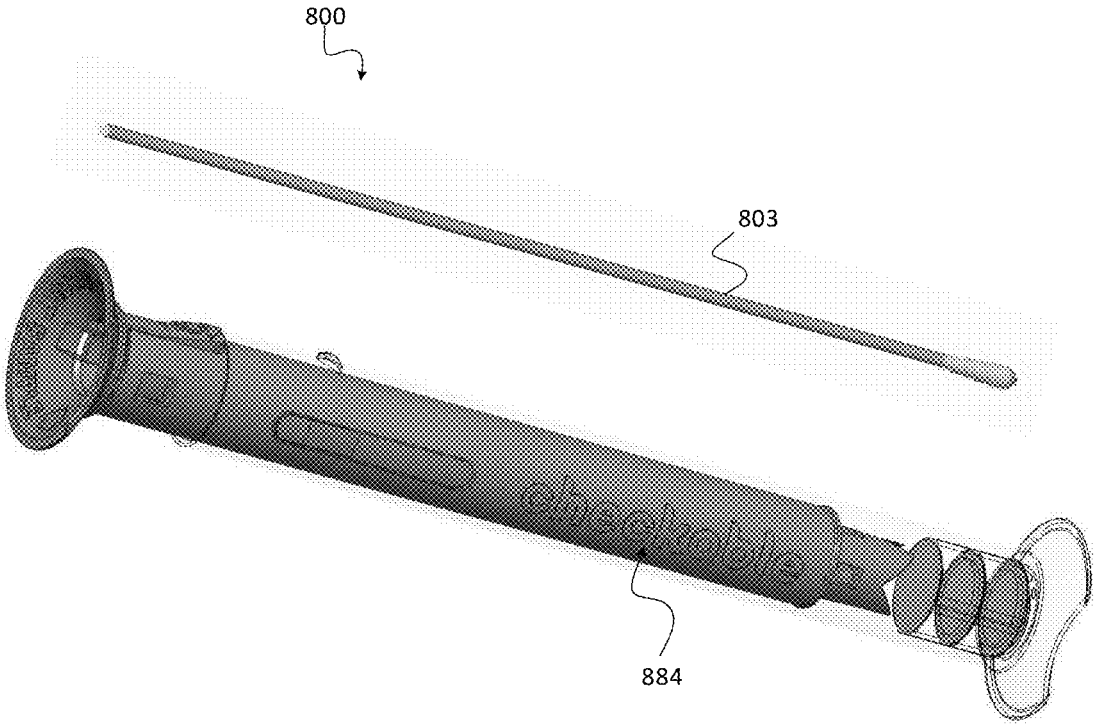
FIG. 8A is a perspective view of another exemplary in vitro test device.

FIG. 8A is perspective view of another exemplary in vitro test device 800 and its associated test swab 803. In some implementations, the test device 800 and test swab 803 are packaged together in a "kit," which may be sold to consumers for purposes of determining whether certain bacteria are present (e.g., group A *Streptococcus* bacteria). Specifically, a user may employ the test swab 803 to take a biological sample (e.g., a pharyngeal sample), then employ the in vitro test device 800 as described herein, to determine—via a rapid, at-home test—whether bacteria of interest are present, such that appropriate follow-up action can be taken (e.g., a prescription antibiotic secured).

Figure 8B:
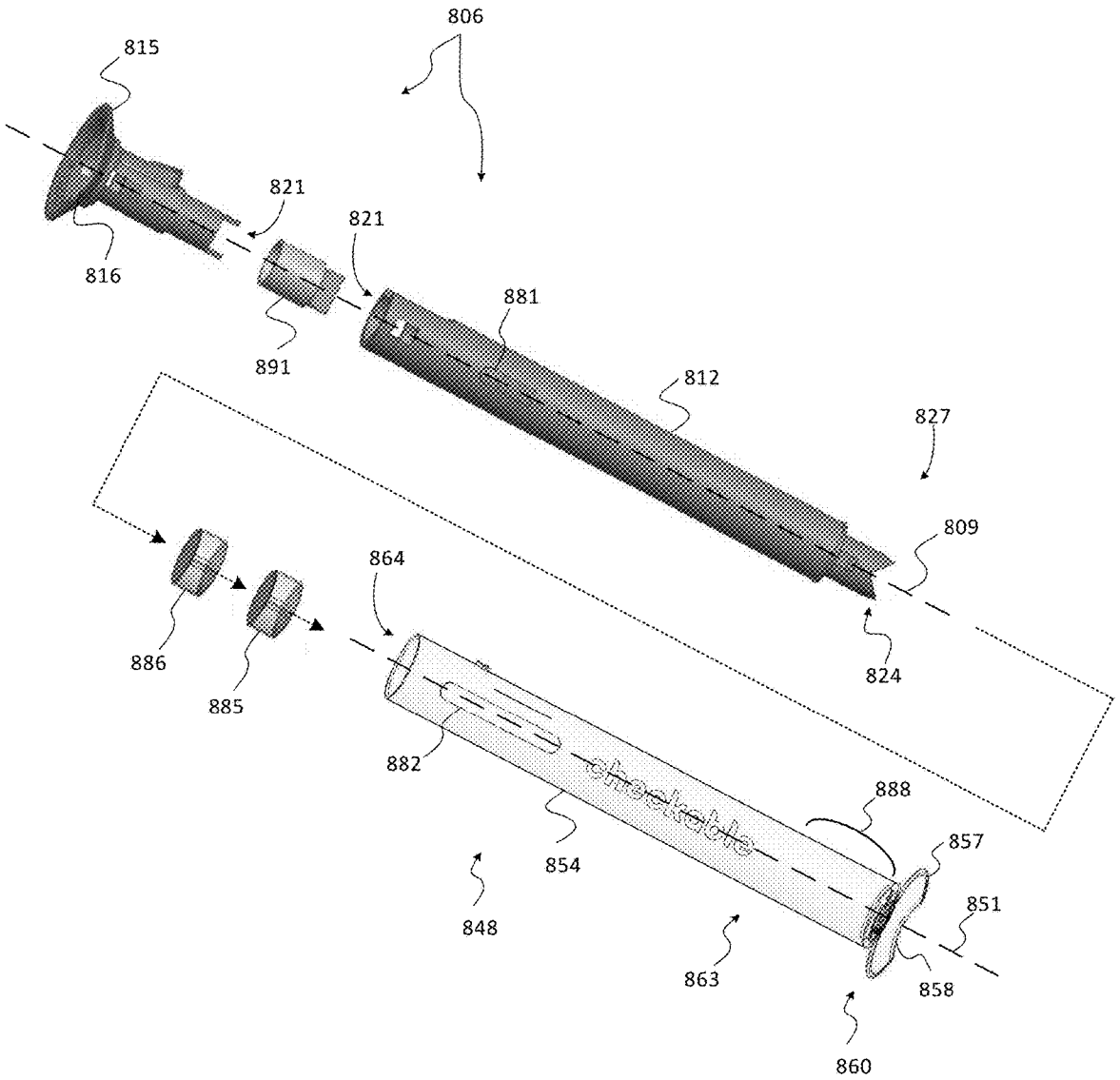
FIG. 8B is an exploded view of the exemplary in vitro test device of FIG. 8A.

As shown in FIG. 8B, the test device 800 includes a plunger 806 and a housing 848. As shown, the plunger 806 has a plunger axis 809 and a sidewall 812 that is parallel to the plunger axis 809. In the implementation shown, the sidewall 812 is a generally cylindrical sidewall; in other implementations, the sidewall 812 could comprise one or more distinct sidewalls, each of which is generally perpendicular to the plunger axis. For example, in some implementations, the sidewall comprises four sides and has a generally square cross-section.

On one end of the plunger 806 is disposed a plunger base 815, which, in some implementations, is perpendicular to the plunger axis 809. The plunger base 815 is open in the middle to allow communication with an interior 821 of the plunger 806. In some implementations, as shown, the plunger 806 is made up of two different portions—one portion including the primary sidewall 812, and one portion including the base 815; such implementations may be configured to retain a diaphragm member 891, which may be included and configured to provide a seal around a test swab 803, when said test swab 803 is inserted into and through the plunger 806. In other implementations, the plunger 806 may be a single unitary piece that includes both the primary sidewall 812 and the plunger base 815.

Opposite the plunger base 815, on a piercing end 827 of the plunger 806, is disposed a piercing member 824. The piercing member 824 is, in some implementations, an angled or sharpened protrusion (or multiple protrusions, as shown in one implementation) that has a smaller diameter (and smaller cross-sectional surface area) than a diameter (or cross-sectional surface area bounded by the sidewalls) of the plunger 806 itself.

Like the plunger base 815, the piercing member 824 is open in the middle to enable communication with the interior 821 of the plunger. In operation, the test swab 803 may be slid into and through the interior 821, through the open middle of the plunger base 815, through the middle of the plunger 806 and out the middle of the piercing member 824.

The test device 800 further includes a housing 848 having a housing axis 851. The housing 848 has a housing sidewall 854 that is parallel to the housing axis 851, and a housing base 857, on a base end 860 of the housing, which is perpendicular to the housing axis 851. The housing base 857 is closed in the middle, such that the housing base 857 and the sidewall 854 form a closed (e.g., liquid-impermeable) vessel 863.

On the housing 848, opposite the housing base end 860, is an open end 864, which is configured to slidably receive the plunger 806. That is, the plunger 806 and housing 848 are configured such that plunger 806 can slide inside the housing 848 with a relatively tight fit (in some implementations, a liquid-tight fit), yet loose enough to permit translation of the two components during operation of the device 800.

In some implementations, the housing base 857 may include a flattened edge 858 to enable the device 800 to lay flat on a horizontal surface without rolling. The plunger base 815 may also have a flattened surface 816. In some implementations, only one of the plunger base 815 or housing base 857 has a flattened edge (816 or 858, respectively); in other implementations, both plunger base 815 and housing base 857 have flatted edges 816 and 858, and the plunger 806 and housing 848 may be keyed in some manner to maintain like orientation of the two flattened edges 816 and 858 (e.g., by a raised nub 881 and corresponding open slot 882, as shown in one implementation).

As shown, the test device 800 further includes reagent pouch 885 and reagent pouch 886. In some implementations, the reagent pouches 885 and 886 are disposed inside the housing 848 adjacent the base end 860, in a reagent region 888. The reagent pouches 885 and 886 may be constructed with sidewalls that are configured to fit into the housing 848; in some implementations, a top and bottom surface (e.g., surfaces that are perpendicular to the housing axis 151) are constructed of a foil, plastic, polymer, or other thin membrane that is easily ruptured, e.g., by translation of the piercing member 824 into the reagent region 888, but that seals and retains reagents until the piercing member 824 releases them.

Figure 8C:
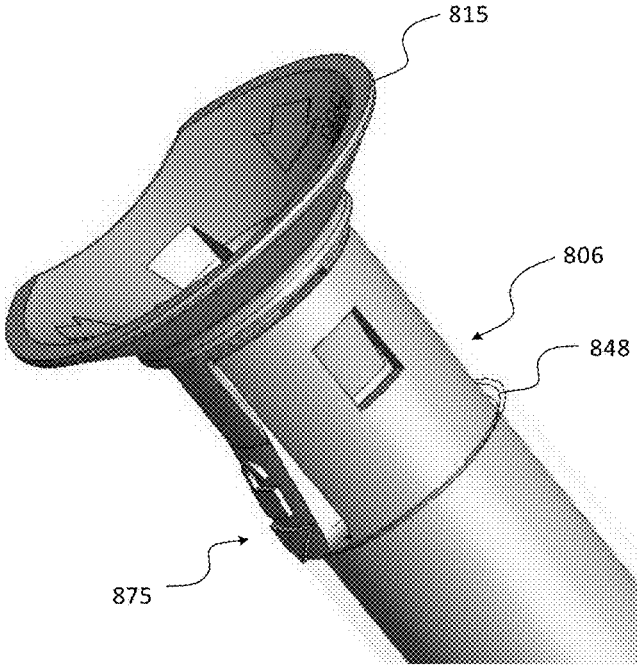
FIGS. 8C-8I illustrate additional details of the exemplary in vitro test device of FIG. 8A.

FIG. 8C illustrates an exemplary locking member 875 that, in some implementations, prevents the plunger 806 from being inadvertently advanced into the corresponding housing 848. In some implementations, the locking member 875 has two configurations—a first configuration, in which the locking member 875 extends beyond an inner diameter of the housing member 848, thereby preventing the plunger 806 from being advanced further into the housing member 848; and a second configuration, in which the locking member 875 can be depressed inward, such that it does not extend beyond an inner diameter of the housing member 848, thereby allowing the plunger 806 to be advanced deeper into the housing 848 (such that its piercing member 824, shown in FIG. 8B, can be translated into the reagent region 888, for example, to pierce reagent pouches 885 and 886 disposed therein).

Figure 8D:
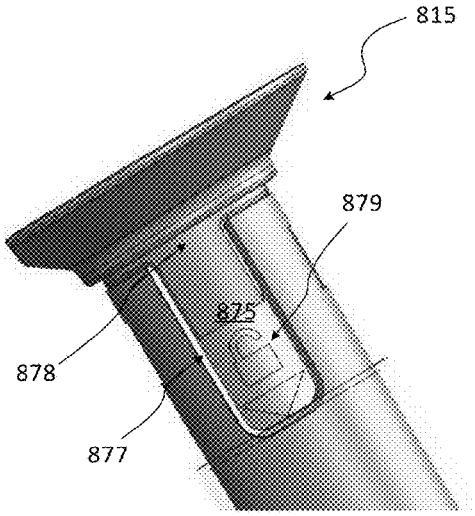

In some implementations, as shown in FIG. 8D, the locking member 875 is a tab that results from a slot 877 being formed in the plunger base 815, with a section 878 of material of the plunger base 815 remaining intact to form a "hinge." A thickness and elasticity of the section 878 may influence how much force the locking 875 exerts to prevent the plunger 806 from being disposed into the housing 848, when the locking member 875 is in a first configuration.

In some implementations, as shown, indicia 879 (e.g., lock symbol and/or a directional arrow) may be formed on the locking member 875, to guide users in the operation of the device 800. In some implementations, the locking member 875 may be colored differently, relative to the plunger 806 and/or plunger base 815, to make the locking member 875 stand out visually (e.g., the locking member may be colored red or green, relative to a gray or white color of the plunger 806).

Figure 8E:
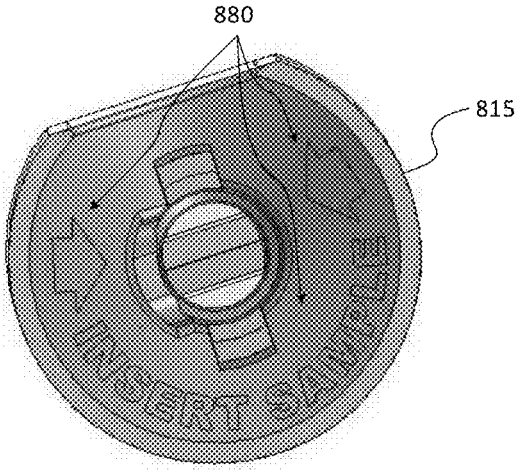
Figure 8F:
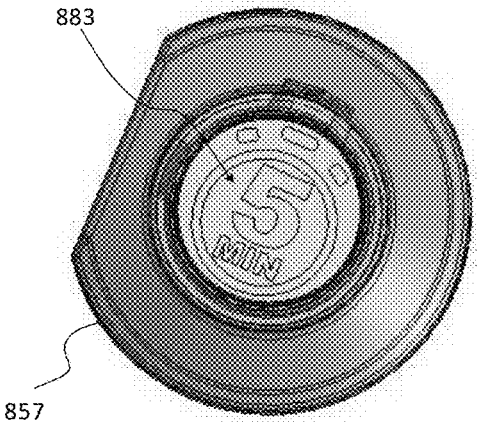

Other indicia may be employed on the device 800, as shown in FIGS. 8E, 8F and 8A. For example, guidance indicia 880 for where a swab is to be inserted in the plunger base 815 may be applied to the plunger base 815 (e.g., through molding, engraving or printing processes). Additional guidance indicia 883 may be provided on the housing base 857, for example to remind a user to retain the device 800 in a particular position for a period of time. A company logo/name 884 may be applied to a portion of the device (see FIG. 8A). Other indicia may be applied. The indicia may be molded or engraved into components of the device 800 itself; or indicia may be printed or applied to, for example, a sticker or coating that is applied to a portion of the device (e.g., to provide additional guidance, user instructions, warnings, or information).

Figure 8G:
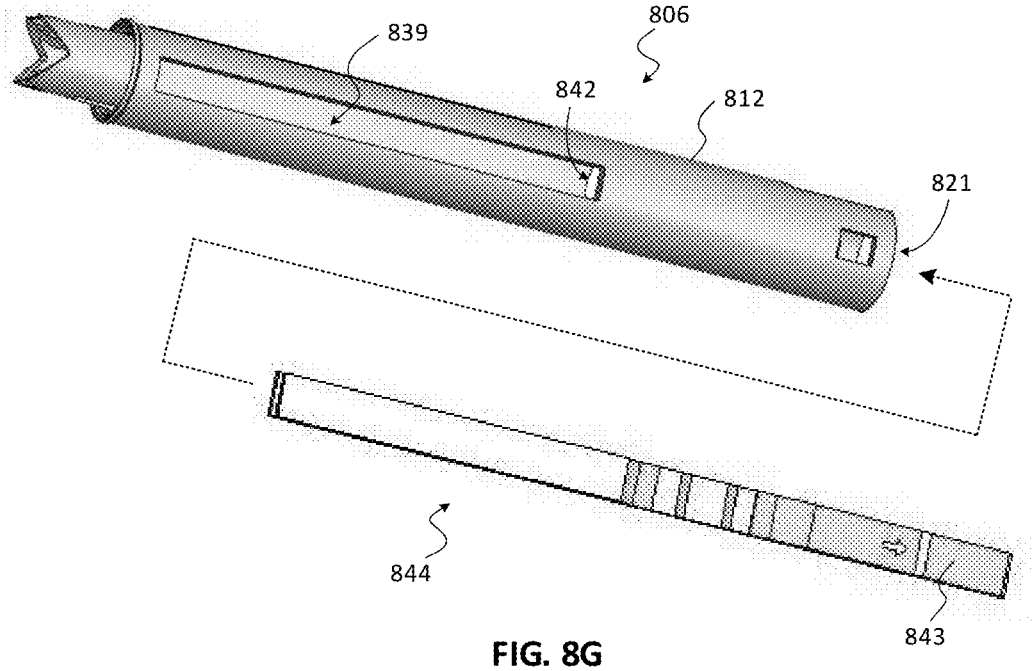

FIG. 8G illustrates additional details of an exemplary plunger 806. Disposed on an exterior surface of the plunger 806 (e.g., recessed in the thickness of sidewall 812) is a test strip channel 839. In the implementation shown, the test strip channel 839 includes an opening 842 into the interior 821 of the plunger. A test strip 844 can be disposed in the test strip channel 839, such that a sample section 843 of the test strip 844 is positioned in the interior 821 of the plunger 806.

Figure 8H:
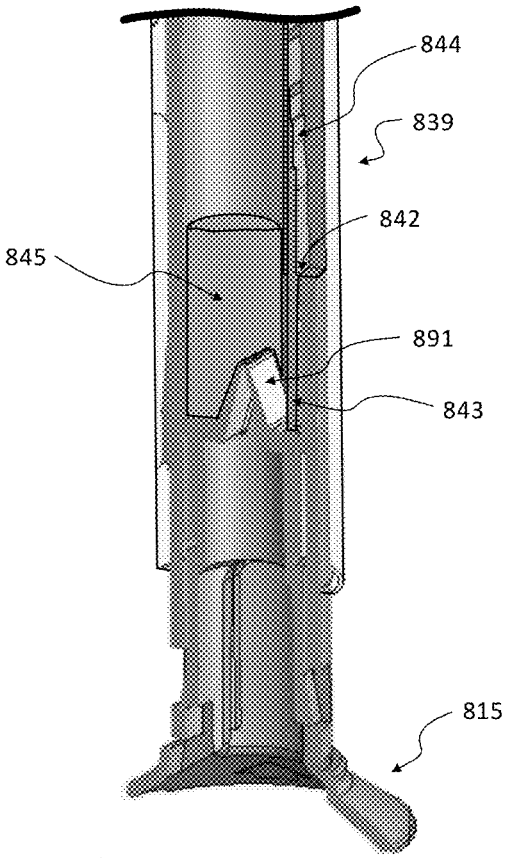

With reference to FIG. 8H and the preceding figures, when the test strip 844 is disposed as just described, and when the reagents are released from their pouches 885 and 886 (e.g., by impingement of the plunger 806, particularly the piercing member 824, into the reagent region 888), and when the device swap is inserted into the plunger 806 (swab not shown in FIG. 8H), and the device 800 flipped upside down, such that the plunger base 815 is on the bottom, the mixed reagents 845 collect against the diaphragm member 891, such that the mixed reagents 845 are in contact with the sample region 843 of the test strip 844. In this manner, in the implementation shown, a patient sample collected on a swab and extracted by the reagents 845 can be absorbed by the test strip 844, and a result (e.g., a positive or negative indication of the presence of a particular analyte, such as Group A *Streptococcus* bacteria) can be obtained.

In some implementations, the diaphragm 891 may also provide a seal that substantially prevents reagent (or much reagent) from leaking out of the interior space 821 (whether or not the test swab 803 is in place), when the test device is rotated such that its plunger base 815 is on the bottom.

Figure 8I:
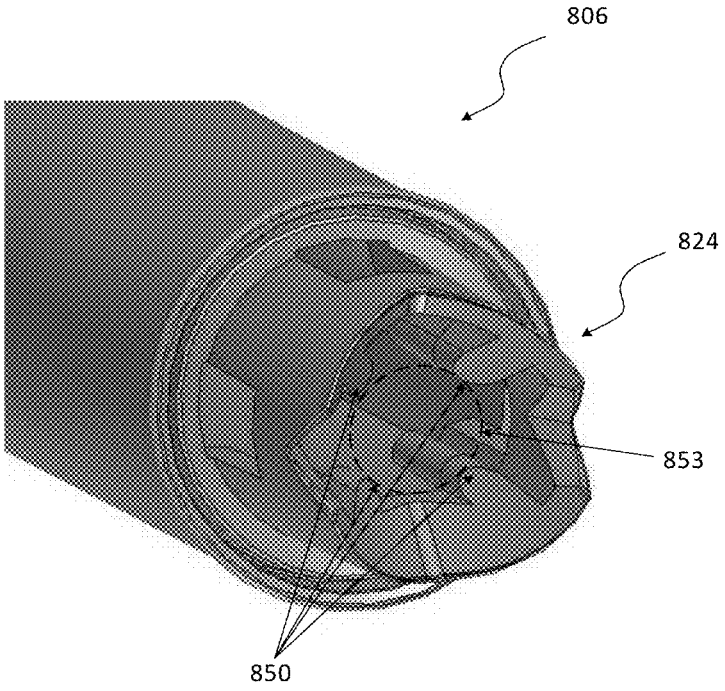

Turning to FIG. 8I, some implementations of a device 800 (e.g., the plunger 806) include features that enhance the extraction of a sample from a test swab. In particular, in the implementation shown, ridges 850 are disposed on an interior wall of the plunger 806. In some implementations, such ridges are configured to form an inner "diameter" 853 that is smaller than an uncompressed diameter of a tip of a corresponding swab 803, such that as the swab 803 is inserted into the device 800 and/or removed from the device 800, its sample-collection tip is compressed in a way that agitates or squeezes additional sample material into the reagent.

Figure 9:
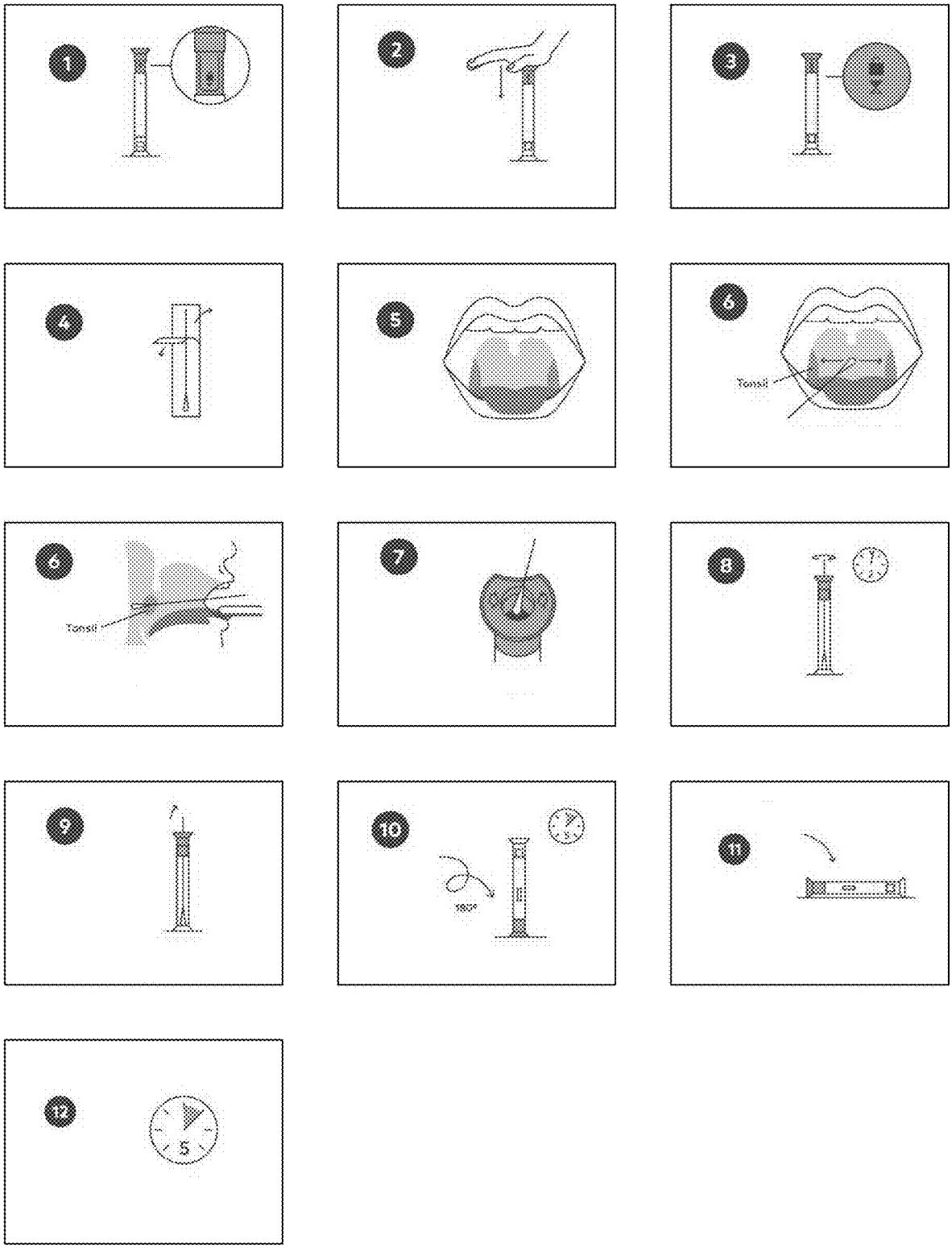
FIG. 9 graphically depicts an exemplary process of using an in vitro diagnostic device.

FIG. 9 graphically depicts a process of using an in vitro diagnostic device, such as the device 800 illustrated in and described with reference to the preceding figures. In a first step, a locking member is released, such that the plunger of the device can be translated into the housing of the device. For example, with reference to FIGS. 8B and 8C, a locking member 875 can be released (e.g., depressed), to enable the plunger 806 to be depressed, or translated, into the housing 848.

The action of depressing the plunger 806 into the housing 848 is depicted in a second step in FIG. 9. This step can cause a piercing member 824 of the plunger to impinge into a reagent region 888, causing the piercing member 824 to pierce reagent pouches 885 and 886 and release the reagents therein, enabling them to mix. In some implementations, the mixing of the reagents may bring about a color change, to provide feedback to a user that the mixing has occurred and that the reagent mixture is ready to receive a biological sample.

In a third step depicted in FIG. 9, confirmation may be made that the plunger is sufficiently translated into the housing. In some implementations, indicia, such as arrows on the plunger and housing, may be closely aligned when the plunger and housing are appropriately positioned relative to each other.

In a fourth step depicted in FIG. 9, a swab may be prepared for sample collection. In some implementations, as shown, this can involve removing the swab from protective packaging in which it is provided.

In a fifth step depicted in FIG. 9, a patient from whom a sample is to be collected (in this example, a pharyngeal sample) can be directed to open his or her mouth. Optionally, a tongue depressor may be employed to hold the patient's tongue down and expose the back of the patient's throat (tongue depressor shown in second frame of a sixth step).

In a sixth step (first frame) depicted in FIG. 9, a tip of the sample collection swab can be rubbed across the back of the patient's throat and against the tonsils and tonsil area. This sixth step is illustrated from the front (first frame) and from the side (second frame). The swab can then be removed from the patient's throat (e.g., without contact with the patient's cheeks, tongue, or teeth).

In a seventh step depicted in FIG. 9, the swab can be inserted into the in vitro diagnostic device. For example, the swab 803, after it has been used to collect a pharyngeal sample, can be inserted into the device 800—specifically, into the interior space 821 of the plunger, through the middle opening of the plunger base 815. The swab can be advanced all the way into the device, past the ridges 850, to the bottom of the housing 848, where the mixed reagent 845 sits.

As depicted in an eighth step in FIG. 9, it can be advisable, in some implementations, to agitate the swab in the reagent mixture for a period of time (e.g., 5 seconds, 10 seconds, etc.), then to leave the device undisturbed for another period of time (e.g., 30 seconds, one minute, two minutes, five minutes, etc.), such that the reagent mixture has an opportunity to extract (e.g., via a chemical reaction and mechanical dispersion) the biological sample from the tip of the swab.

As depicted in a ninth step in FIG. 9, the swab can, in some implementations, be removed from the device. In some implementations, the step of removing the swab from the device can cause additional sample material to be "squeezed" out of the swab (e.g., by the ridges 850 and/or the diaphragm member 891).

As depicted in a tenth step in FIG. 9, the device can be rotated 180 degrees. For example, the device 800 can be flipped from resting on its housing base 857 to its plunger base 815. In some implementations, as illustrated in FIG. 8H, this can cause mixed reagent 845 to move from the bottom of the housing 848, in the reagent region 888, to an area adjacent the diaphragm member 891 and, more importantly, to an area where the sample section 843 of the test strip 844 is positioned. In this position, the mixed reagent 845—with its biological sample contained therein—is drawn into the test strip 844, where presence of a particular analyte (e.g., Group A *Streptococcus* bacteria) can be detected.

As depicted in a eleventh step in FIG. 9, the device can be laid on its side. For example, the device 800 may be laid on its side, such that that the flat region 816 of the plunger base 815 and/or flat region 858 of the housing base 857 are resting on a surface, such as a table. In this position, in some implementations, the test strip 844 is visible to a user—that is, the test strip 844 is facing up or out for easy viewing.

In some implementations, a period of time is required for the reagent/sample mixture to be drawn into the test strip. This waiting period (e.g., one minute, two minutes, five minutes, ten minutes, etc.—as specified in instructions associated with the device) is depicted in a twelfth step in FIG. 9. After this period, or within aa particular time window (e.g., between five and ten minutes), the test strip can be read. For example, the test strep 366 shown in FIG. 3 may be read to confirm the presence of a control line 395 and the presence or absence of a test line 394. As described with reference to FIG. 3, the presence of the test line 394 can indicate a positive result (e.g., affirmative detection of an analyte of interest), and the absence of the test line 394 can indicate a negative result (e.g., indication that the analyte of interest was not detected).

While various implementations have been described with reference to exemplary aspects, it will be understood by those skilled in the art that various changes may be made and equivalents may be substituted for elements thereof without departing from the contemplated scope. For example, a cylindrical housing is described, but housing could take another shape, such as one with a square cross-section. Two reagents are described, but in some implementations, there may be a single reagent; in other implementations, there may be three or more reagents. A lateral flow test strip may have multiple test strips and thus be able to detect multiple analytes. One or more incubation periods may be unnecessary in some implementations; in other implementations, one or more incubation periods may be longer or shorter than specified. Agitation may be required in some implementations but not in other implementations. Analytes other than those associated with Group A *Streptococcus* may be detected. For example, some in vitro diagnostic devices may be employed to detect urinary tract infections, yeast infections, sexually transmitted diseases, other infectious diseases, etc.

In general, many modifications may be made to adapt a particular situation or material to the teachings provided herein without departing from the essential scope thereof. Therefore, it is intended that the scope not be limited to the particular aspects or embodiments disclosed but include all aspects falling within the scope of the appended claims.

What is claimed is:

1. An in vitro test device comprising:

a plunger having a plunger axis; a cylindrical plunger sidewall that is parallel to the plunger axis; a plunger base that is perpendicular to the plunger axis and open in the middle to enable communication with an interior of the plunger; a piercing member that is open in the middle to enable fluid communication with the interior of the plunger and that has a smaller cross-sectional area than that bounded by the one or more plunger sidewalls; a test strip channel disposed in a sidewall in the one or more plunger sidewalls; a diaphragm member disposed in the plunger; and ridges disposed on an interior wall of the plunger;

a housing having a housing axis; a cylindrical housing sidewall that is parallel to the housing axis; a housing base on a housing base end, which is perpendicular to the housing axis and closed in the middle, such that the housing base and the cylindrical housing sidewall forms a liquid-impermeable vessel; and an open end opposite the housing base that slidably receives the plunger;

one or more reagent pouches disposed inside the housing, adjacent the housing base end, in a reagent region;

a lateral flow test strip disposed in the test strip channel; and a locking member having a first configuration and a second configuration;

wherein, in the first configuration, the locking member prevents the piercing member from impinging into the reagent region, and wherein, in the second configuration, the locking member allows the plunger to be translated into the housing such that the piercing member impinges into the reagent region;

wherein the diaphragm member is configured to prevent reagent from the one or more reagent pouches from leaking out of the interior of the plunger when the reagent has been released from the one or more reagent pouches and when the in vitro test device is positioned vertically on its plunger base.

2. The in vitro test device of claim 1, wherein the ridges are configured to compress a sample collection portion of a test swab, as the test swab is passed through the interior of the plunger.

3. An in vitro test device comprising:

a plunger having a plunger axis; one or more plunger sidewalls that are parallel to the plunger axis; a plunger base that is perpendicular to the plunger axis and open in the middle to enable communication with an interior of the plunger; a piercing member that is open in the middle to enable fluid communication with the interior of the plunger and that has a smaller cross-sectional area than that bounded by the one or more plunger sidewalls; and, a test strip channel disposed in a sidewall in the one or more plunger sidewalls;

a housing having a housing axis; one or more housing sidewalls that are parallel to the housing axis; a housing base on a housing base end, which is perpendicular to the housing axis and closed in the middle, such that the housing base and the one or more housing sidewalls form a liquid-impermeable vessel; and an open end opposite the housing base that slidably receives the plunger;

one or more reagent pouches disposed inside the housing, adjacent the housing base end, in a reagent region;

a lateral flow test strip disposed in the test strip channel; and a locking member having a first configuration and a second configuration;

wherein, in the first configuration, the locking member prevents the piercing member from impinging into the reagent region, and wherein, in the second configuration, the locking member allows the plunger to be translated into the housing such that the piercing member impinges into the reagent region.

4. The in vitro test device of claim 3, wherein the one or more sidewalls comprise a single sidewall having a generally cylindrical form.

5. The in vitro test device of claim 3, wherein the one or more sidewalls comprise four sidewalls having a generally square cross section.

6. The in vitro test device of claim 3, further comprising a diaphragm member disposed in the plunger; wherein the diaphragm member is configured to prevent reagent that has been released from the one or more reagent pouches from leaking out of the interior of the plunger when the in vitro test device is positioned vertically on its plunger base.

7. The in vitro test device of claim 6, wherein the test strip channel comprises an opening into the interior of the plunger, such that when a test strip is disposed in the test strip channel, a portion of the test strip is adjacent the diaphragm member.

8. The in vitro test device of claim 3, wherein the plunger further comprises ridges disposed on an interior wall of the plunger and spaced to compress a sample collection portion of a test swab, as the test swab is passed through the interior of the plunger.

9. The in vitro test device of claim 3, wherein at least one of the plunger base and housing base comprise a flat edge that prevents the in vitro test device from rolling when the in vitro test device is positioned horizontally relative to a surface and the flat edge is in contact with the surface.

10. The in vitro test device of claim 9, wherein each of the plunger base and the housing base comprise a flat edge, the in vitro test device further comprising a keying mechanism to align the plunger and housing in a fixed orientation relative to each other and to a plunger axis and a housing axis.

11. The in vitro test device of claim 3, further comprising indicia on at least one of the plunger base or housing base, which indicia provide a user with instructions regarding using the in vitro test device.

12. The in vitro test device of claim 11, wherein the indicia include indicia to guide manipulation of the plunger relative to the housing, or a test swab associated with the in vitro test device relative to the plunger.

13. The in vitro test device of claim 11, wherein the indicia include indicia to guide a user with respect to a time period during which the in vitro test device is to be positioned in a specific spatial orientation.

14. A method of identifying the presence of an analyte, the method comprising:

providing an in vitro test device and a test swab, the in vitro test device comprising (a) a plunger having a plunger axis; one or more plunger sidewalls that are parallel to the plunger axis; a plunger base that is perpendicular to the plunger axis and open in the middle to enable communication with an interior of the plunger; a piercing member that is open in the middle to enable fluid communication with the interior and that has a smaller cross-sectional area than that bounded by the one or more plunger sidewalls; and, a test strip channel disposed in a sidewall in the one or more plunger sidewalls; (b) a housing having a housing axis; one or more housing sidewalls that are parallel to the housing axis; a housing base on a housing base end, which is perpendicular to the housing axis and closed in the middle, such that the housing base and the one or more housing sidewalls form a liquid-impermeable vessel; and an open end opposite the housing base that slidably receives the plunger; (c) one or more reagent pouches disposed inside the housing, adjacent the housing base end, in a reagent region; (d) a lateral flow test strip disposed in the test strip channel; (e) a locking member having a first configuration and a second configuration; wherein, in the first configuration, the locking member prevents the piercing member from impinging into the reagent region, and wherein, in the second configuration, the locking member allows the plunger to be translated into the housing such that the piercing member impinges into the reagent region;

obtaining a sample using the test swab;

transitioning the locking member from the first configuration to the second configuration;

advancing the plunger into the housing to pierce the one or more reagent pouches in the reagent region to cause reagent therein to be released and mix;

inserting the test swab with obtained sample into the interior of the plunger;

rotating the in vitro test device and disposing it on its plunger base; and determining whether the analyte is present.

15. The method of claim 14, further comprising agitating at least one of the test swab or the in vitro test device.

16. The method of claim 14, wherein rotating the in vitro test device comprises rotating after an extraction incubation period.

17. The method of claim 14, wherein a mixing incubation period separates the advancing and inserting steps.

18. The method of claim 14, wherein determining comprises determining based on observation of a results section of the lateral flow test strip.

19. The method of claim 18, wherein determining comprises determining after a testing incubation period.

20. The method of claim 14, wherein at least one of the plunger base and the housing base comprises a flat edge, the method further comprising rotating the in vitro test device such that its plunger axis and housing axis are parallel to a horizontal surface, and resting the flat edge on the horizontal surface.

* * * * *